US007344450B2

(12) United States Patent
Billings

(10) Patent No.: US 7,344,450 B2
(45) Date of Patent: Mar. 18, 2008

(54) METHOD FOR ADJUSTING THE CENTER OF GRAVITY OF A GOLF CLUB HEAD

(75) Inventor: David P. Billings, McKinney, TX (US)

(73) Assignee: Dogleg Right Corporation, Dallas, TX (US)

( * ) Notice: Subject to any disclaimer, the term of this patent is extended or adjusted under 35 U.S.C. 154(b) by 0 days.

(21) Appl. No.: 11/467,136

(22) Filed: Aug. 24, 2006

(65) Prior Publication Data

US 2006/0287128 A1 Dec. 21, 2006

Related U.S. Application Data

(63) Continuation of application No. 11/313,137, filed on Dec. 20, 2005, now Pat. No. 7,189,169, which is a continuation of application No. 10/043,421, filed on Jan. 10, 2002, now Pat. No. 7,004,852.

(51) Int. Cl.
*A63B 53/04* (2006.01)

(52) U.S. Cl. ..... 473/324; 473/322; 473/334; 473/338; 473/339; 473/349; 473/409

(58) Field of Classification Search ..... 473/324–350, 473/256, 291–292, 409
See application file for complete search history.

(56) References Cited

U.S. PATENT DOCUMENTS 1,167,106 A 1/1916 Palmer
1,213,382 A 1/1917 Kent
1,453,503 A 5/1923 Holmes
1,526,438 A 2/1925 Scott
1,538,312 A 5/1925 Beat
1,568,888 A 1/1926 Dunn
1,756,219 A 4/1930 Spiker
1,868,286 A 7/1932 Grieve
2,067,556 A 1/1937 Wettlaufer
2,163,091 A 6/1939 Held
2,171,383 A 8/1939 Wettlaufer
2,198,981 A 4/1940 Sullivan
2,214,356 A 9/1940 Wettlaufer
2,225,930 A 12/1940 Sexton
2,328,583 A 9/1943 Reach
2,332,342 A 10/1943 Reach
2,460,445 A 2/1949 Bigler
2,998,254 A 8/1961 Rains et al.
3,075,768 A 1/1963 Karns
3,143,349 A 8/1964 MacIntyre
3,466,047 A 9/1969 Rodia et al.
3,606,327 A 9/1971 Gorman (Continued)

FOREIGN PATENT DOCUMENTS

JP H6-126004 A 5/1994

(Continued)

*Primary Examiner*—Sebastiano Passaniti
(74) *Attorney, Agent, or Firm*—Carr LLP

(57) ABSTRACT

A metal golf club head that allows a user to customize the location of the center of gravity. The metal golf club head comprises a hollow body with a weighting port. The weighting port allows a user to place weighting material inside the hollow body, customizing the location of the center of gravity, the swing weight, the total weight, and the balance of the golf club.

18 Claims, 3 Drawing Sheets

U.S. PATENT DOCUMENTS 3,610,630 A 10/1971 Glover
3,652,094 A 3/1972 Glover
3,680,868 A 8/1972 Jacob
3,749,408 A 7/1973 Mills
3,976,299 A 8/1976 Lawrence et al.
3,979,123 A 9/1976 Belmont
4,008,896 A 2/1977 Gordos
4,085,934 A 4/1978 Churchward
4,180,269 A 12/1979 Thompson
4,214,754 A 7/1980 Zebelean
4,325,553 A 4/1982 Taylor
4,340,230 A 7/1982 Churchward
4,417,731 A 11/1983 Yamada
4,423,874 A 1/1984 Stuff, Jr.
4,432,549 A 2/1984 Zebelean
4,502,687 A 3/1985 Kochevar
4,607,846 A 8/1986 Perkins
4,655,459 A 4/1987 Antonious
4,695,054 A 9/1987 Tunstall
4,754,977 A 7/1988 Sahm
4,811,950 A 3/1989 Kobayashi
4,824,116 A 4/1989 Nagamoto et al.
4,828,266 A 5/1989 Tunstall
4,867,458 A 9/1989 Sumikawa et al.
4,869,507 A 9/1989 Sahm
4,895,371 A 1/1990 Bushner
4,927,144 A 5/1990 Stormon
4,944,515 A 7/1990 Shearer
5,013,041 A 5/1991 Sun et al.
5,050,879 A 9/1991 Sun et al.
5,056,705 A 10/1991 Wakita et al.
5,058,895 A 10/1991 Igarashi
5,064,197 A 11/1991 Eddy
5,078,400 A 1/1992 Desbiolles et al.
5,082,278 A 1/1992 Hsien
5,184,823 A 2/1993 Desboilles et al.
5,193,806 A 3/1993 Burkly
5,219,408 A 6/1993 Sun
5,244,210 A 9/1993 Au
5,273,283 A 12/1993 Bowland
5,289,865 A 3/1994 Sun
5,316,298 A 5/1994 Hutin et al.
5,316,305 A 5/1994 McCabe
5,322,285 A 6/1994 Turner
5,351,958 A 10/1994 Helmstetter
5,385,348 A 1/1995 Wargo
5,407,202 A 4/1995 Igarashi
5,447,309 A 9/1995 Vincent
5,482,282 A 1/1996 Willis
5,518,243 A 5/1996 Redman
5,522,593 A 6/1996 Kobayashi et al.
5,533,730 A 7/1996 Ruvang
5,558,226 A 9/1996 Fritz
5,570,886 A 11/1996 Rigal et al.
5,746,664 A 5/1998 Reynolds, Jr.
5,755,624 A 5/1998 Helmstetter
5,766,092 A 6/1998 Mimeur et al.
5,797,807 A 8/1998 Moore
5,851,160 A 12/1998 Rugge et al.
5,855,525 A 1/1999 Turner
5,911,638 A 6/1999 Parente et al.
5,913,735 A 6/1999 Kenmi
5,947,840 A 9/1999 Ryan
5,961,394 A 10/1999 Minabe
6,001,024 A 12/1999 Van Alen, II et al.
6,015,354 A 1/2000 Ahn et al.
6,030,295 A 2/2000 Takeda
6,089,994 A 7/2000 Sun
6,206,790 B1 3/2001 Kubica et al.
6,248,025 B1 6/2001 Murphy et al.
6,254,494 B1 7/2001 Hasebe et al.
6,290,609 B1 9/2001 Takeda
6,306,048 B1 10/2001 McCabe et al.
6,309,311 B1 10/2001 Lu
6,315,678 B1 11/2001 Teramoto
6,364,788 B1 4/2002 Helmstetter et al.
6,443,851 B1 9/2002 Liberatore
6,514,154 B1 2/2003 Finn
6,530,848 B2 3/2003 Gillig
6,716,111 B2 4/2004 Liberatore
6,923,734 B2 8/2005 Meyer
6,991,558 B2 1/2006 Beach et al.
7,004,852 B2 2/2006 Billings
7,108,609 B2 * 9/2006 Stites et al. ..... 473/256
7,147,570 B2 * 12/2006 Toulon et al. ..... 473/290
7,198,575 B2 * 4/2007 Beach et al. ..... 473/324
2002/0065144 A1 5/2002 Helmstetter et al.
2002/0137576 A1 * 9/2002 Dammen ..... 473/336

FOREIGN PATENT DOCUMENTS

JP H7-15067 A 3/1995
JP H11-9742 A 1/1999
JP 2000-24149 A 1/2000

* cited by examiner

METHOD FOR ADJUSTING THE CENTER OF GRAVITY OF A GOLF CLUB HEAD

CROSS-REFERENCE TO RELATED APPLICATIONS

This application is a continuation of, and claims the benefit of the filing date of, co-pending U.S. patent application Ser. No. 11/313,137 entitled CUSTOMIZABLE CENTER-OF-GRAVITY GOLF CLUB HEAD, filed Dec. 20, 2005, which is a continuation of U.S. patent application Ser. No. 10/043,421 entitled CUSTOMIZABLE CENTER-OF-GRAVITY GOLF CLUB HEAD, filed Jan. 10, 2002, now U.S. Pat. No. 7,004,852.

BACKGROUND OF THE INVENTION

1. Field of the Invention

The invention relates generally to golf clubs and, more particularly, to a golf club head in which the center of gravity, balance, and weight are customizable and can be altered to suit changing course conditions, weather conditions, and/or other user requirements.

2. Description of Related Art

Golfers have long recognized that they could alter the weight, balance, and performance characteristics by selectively adding weight to club heads. Typically, weight is added by applying thin strips of lead tape with an adhesive backing to the club head. In this manner the swing weight is increased and the center of gravity (CG) is altered to change the dynamics of the head during the swing and, therefore, the ball flight characteristics after contact. The location of the lead tape, however, is generally limited to the back, crown, and/or sole of the club heads where it would best stay affixed and not alter the look of the club, but this limits the adjustability options available to the golfer. For example, the lead tape could not be put on the face of the club to move the CG closer to the front of the club which is more desirable to some golfers who want the club to be easier to "work", i.e., to shape shots both in a left-to-right manner and in a right-to-left manner.

Furthermore, this use of lead tape was generally an additive process whereby the swing weight and total weight of the club was increased, often times negatively effecting other performance characteristics of the club. Some golfers overcame this obstacle by grinding down or using other means to reduce the weight of the club. However, this often damaged the protective finish of the club or the shape and configuration intended by the club designer, negatively effected the after market value of the club, and was difficult and time consuming for the golfer to adjust.

Furthermore, manufacturers of golf clubs have encountered problems when attempting to manufacture individual clubs to identical specifications because of variances of the individual components themselves and when assembled together. Generally, manufacturers build clubs to a weight at, or slightly below, a targeted weight specification and then add additional weight in the head and/or the shaft to increase the total weight and/or the swing weight to the desired specification. Additional weight is commonly added by pouring lead powder into the bottom of the shaft and sealing the shaft with a cork or other means. Alternatively, lead powder has been mixed with putty, epoxy, or other materials that are inserted into the end of the shaft of the assembled head and shaft to facilitate this final weight adjustment by the manufacturer. This method, however, alters the CG of the club away from the optimal location, adversely effecting performance and feel.

Additionally, a common practice has been to inject a hot melt glue or similar material into a hole in the club head during final assembly to arrive at a prescribed swing weight. The location that the glue puddles and adheres to the inner walls is determined by the orientation of the head while the glue is still hot and fluid. Furthermore, this technique has been used to customize the center of gravity of the club head for specific golfers' needs. The location of the glue, however, is generally limited to one broad area due to the closed process, and once the glue is set, the glue is not adjustable.

Several methods have been attempted to create a golf club that allows the weight, balance, and CG of golf club heads to be altered. One example is disclosed in U.S. Pat. No. 6,254,494 to Hasebe, et al. (hereinafter "Hasebe"), entitled, "Golf club head". The weights, which effect CG location and club head dynamics during the swing and the ball flight after contact, can be changed during manufacturing. Once manufactured, however, the weights can not be altered or be customized for individual needs. Therefore, a club head must be manufactured for each desired weighting configuration.

Another example is disclosed in U.S. Pat. No. 6,248,025 to Murphy, et al. (hereinafter "Murphy"), entitled, "Composite golf club head and method of manufacturing". Murphy discloses a weight strip within a ribbon of the body of the club head. Weights in the form of densified loaded films and/or ribbons of material denser than the primary composite material of the head are added to the internal structure to assertedly increase the forgiveness and playability characteristics, including the energy transfer. Murphy discloses that the location and configuration of the weights can be changed during manufacture to achieve varying characteristics, but, once the weights are added and the club head is completed in manufacturing, the weights can not be altered.

Yet another example is disclosed in U.S. Pat. No. 6,206,790 by Kubica, et al. (hereinafter "Kubica"), entitled "Iron type golf club head with weight adjustment member". Kubica assertedly discloses a weight adjustment member located within a secondary cavity within the back of a cavity back iron golf club head. The weight adjustment member is said to be chosen from a plurality of weight adjustment members to overcome variances in manufacturing tolerances and to adjust golf club swing weights to custom fit various golfers' requirements. The weight adjustment member, however, does not allow the position of the CG to be altered.

Yet still another example is disclosed in U.S. Pat. No. 3,652,094, to Glover (hereinafter "Glover"), entitled, "Golf club with adjustable weighting plugs". Glover assertedly discloses the use of threaded weight plugs to alter the CG. The location of the CG in Glover, however, is limited to the position of the threaded cavities. Similarly, U.S. Pat. No. 5,050,879 to Sun, et al. (hereinafter "Sun"), entitled, "Golf driver with variable weighting for changing center of gravity", assertedly discloses three cavities that are sealed by a cover plate in the sole where weight members can be selectively installed. However, the user's options for the location of the weight members is limited to adjustment between the three predetermined cavities, in the horizontal plane from heel to toe, and near the sole only.

Yet still another example is disclosed in U.S. Pat. No. 6,306,048 to McCabe, et al. (hereinafter "McCabe"), entitled, "Golf club with weight adjustment". McCabe assertedly discloses one or more weight chambers that the golfer uses to adjust the weight and CG of a club to customize it to his or her own needs. A filler material is used to set the weights in position. This method, however, limits the weights and weight changes to the location of the internal weight chamber, and, once the filler material is set, the golfer can no longer adjust the weight or center of gravity.

Therefore, there is a need for a golf club head with a customizable CG that allows the CG to be altered by a golfer and/or the manufacturer.

SUMMARY

The present invention provides a metal golf club head that allows a user to customize the location of the center of gravity. The metal golf club head comprises hollow-body golf club head with a weighting port that allows the user to access the interior of the hollow-body golf club head. The weighting port allows a user to place weighting material, such as lead tape and the like, inside the golf club head, thereby customizing the location of the center of gravity.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
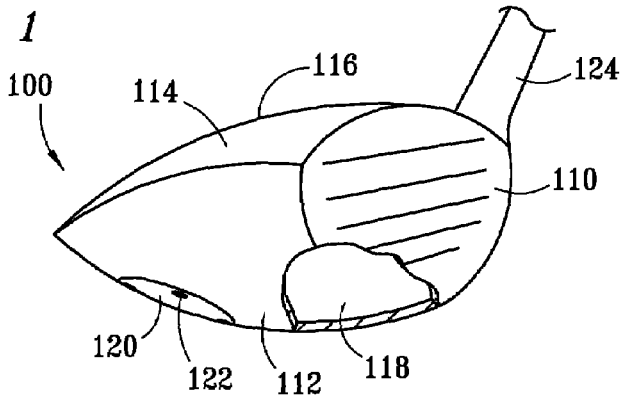
FIG. 1 illustrates a metal golf club head that embodies features of the present invention.
Figure 3:
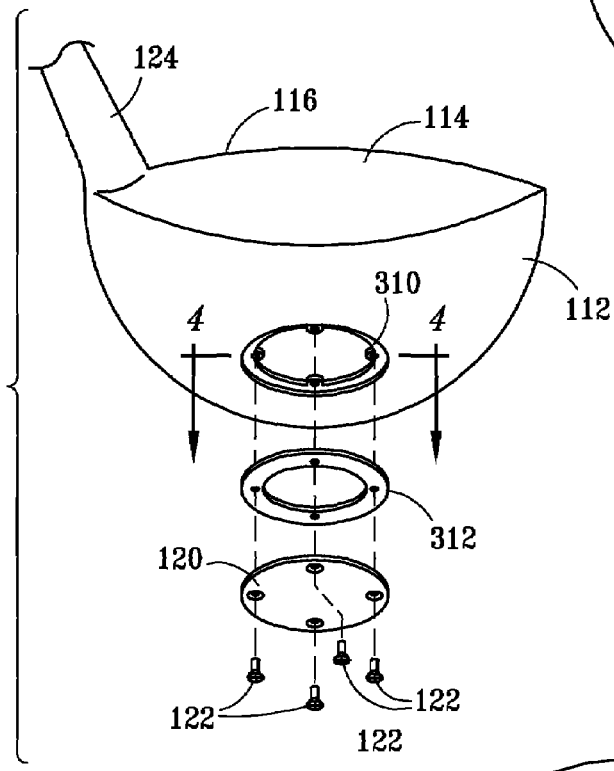
FIG. 3 illustrates a rear view of a metal golf club head with a weighting port cover removed that embodies features of the present invention.

Referring to FIG. 1 of the drawings, the reference numeral 100 generally designates a hollow golf club head embodying features of the present invention. The hollow golf club head 100 generally comprises a face portion 110, an integrated sole and wall portion 112, and a crown portion 114 defining a body 116 with an interior cavity 118. A hosel portion 124 is connected to and/or integrated into the body 116 for receiving a shaft (not shown). Furthermore, a removable, port cover 120, which is described in further detail below with reference to FIG. 3, provides access to the interior cavity 118, thereby allowing the placement of weighting material, such as lead tape, into the interior cavity 118.

In the preferred embodiment, the hollow golf club head 100 comprises a two-piece golf club head. The first piece comprising the integrated sole and wall portion 112 and the face portion 110, including the hosel portion 124. The second piece comprises the crown portion 114, which is welded or otherwise attached to the first piece. Other embodiments, such as a three-piece golf club head, however, may be used as is known in the art.

Figure 2:
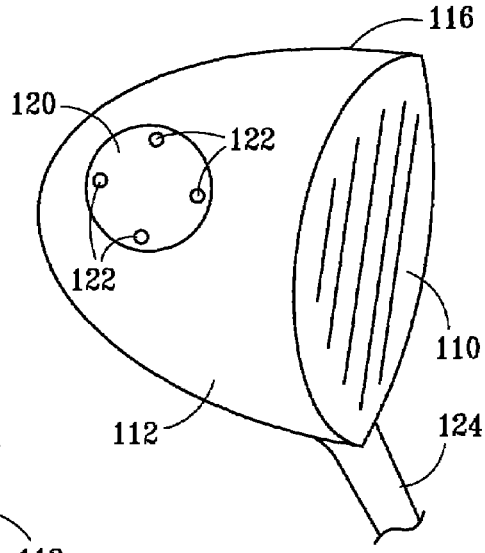
FIG. 2 illustrates a bottom view of a metal golf club head that embodies features of the present invention.

FIG. 2 is a bottom view of the hollow golf club head 100, further illustrating the positioning and sizing of the weighting-port cover 120 in the preferred embodiment. Preferably, the weighting-port cover 120 is positioned on the bottom, i.e., the sole, of the hollow golf club head 100 and away from the face portion 110. Therefore, the weighting-port cover 120 is preferably positioned such that the weighting-port cover 120 is not visible by a golfer when addressing a golf ball. Furthermore, the placement of the weighting-port cover 120 away from the face portion 110 allows placement of weighting material about, or on, the interior side of the face portion 110, and along the heal/toe portions of the hollow golf club head 100, as will be described in greater detail below with reference to FIG. 4.

The weighting port cover 120 is preferably attached to the body 116 via a plurality of flush-mounted bolts 122, and, optionally, may be coated with a friction-reducing material, such as Teflon. In order to reduce the friction, the possibility of the weighting-port cover to "snag" onto grass, thereby affecting the swing path, and the wear and tear, the weighting-port cover 120 is flush-mounted to the integrated sole and wall portion 112 by the plurality of flush-mounted bolts 122.

FIG. 3 illustrates the hollow golf club head 100 with the weighting-port cover 120 removed. The body 116 preferably includes a recessed portion 310 configured for receiving an optional vibration-dampening ring 312 and the weighting-port cover 120. The vibration-dampening ring 312, such as a ring made from foam, rubber, and/or the like, allows the weighting-port cover 120 to be securely fastened, preventing a vibration/rattling noise that may occur as a result of swinging the club and/or striking a ball and sealing the interior cavity from exposure to outside elements, such as sand, water, and/or the like.

The plurality of flush-mounted bolts 122 pass through the weighting-port cover 120 and screw into the recessed portion 310 of the body 116. Alternatively, other methods, such as a weighting-port cover that screws into the body 116, latches, press-fits, or the like, may be used. The preferred embodiment, however, allows for weighting-port cover 120 that is curved to match the contour of the body.

Figure 4:
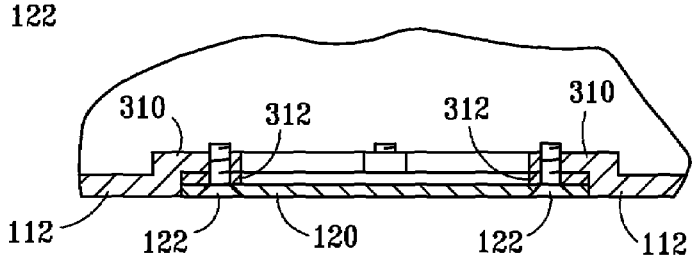
FIG. 4 illustrates a cross-section view with the weighting port cover attached that embodies features of the present invention.

FIG. 4 illustrates a side view of the weighting-port cover 120 attached to the body 116 in accordance the one embodiment of the present invention depicted in FIG. 3. As one skilled in the art will appreciate, the recessed portion 310 allows a smooth contour to be formed by the integrated sole and wall portion 112 and the weighting-port cover 120 when assembled. In an alternative embodiment, however, the weighting-port cover 120 is recessed from the integrated sole and wall portion.

Figure 5:
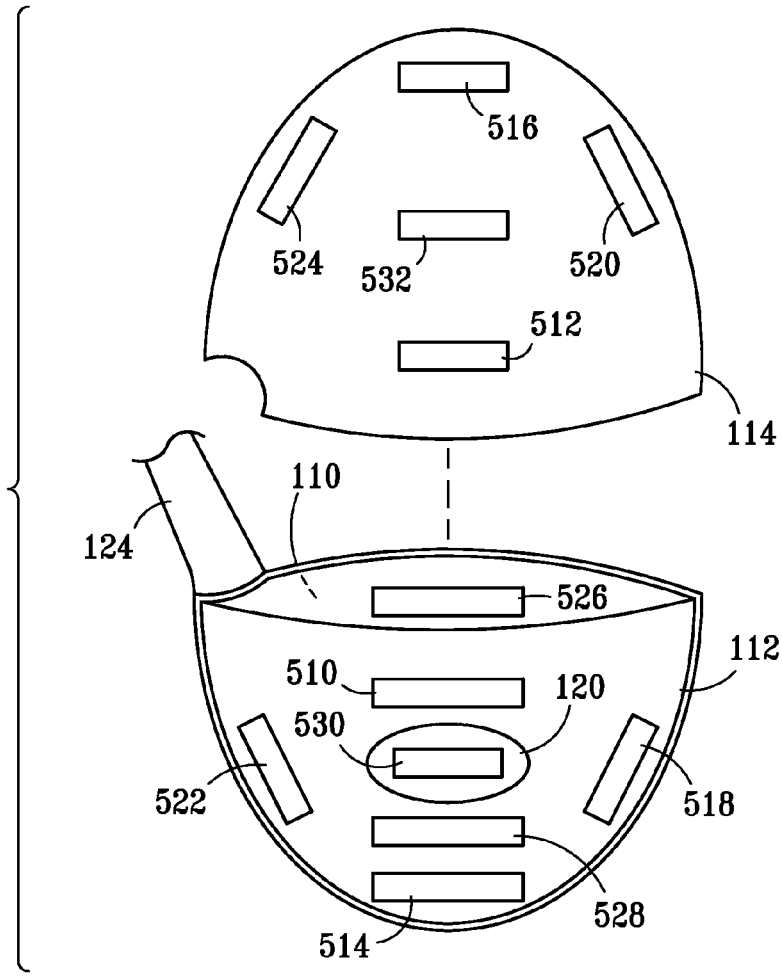
FIG. 5 illustrates a metal golf club head with the crown portion removed to indicate some positions of weighting material.

FIG. 5 illustrates the hollow golf club head 100 with the crown portion 114 separated from the integrated sole and wall portion 112 in order to illustrate potential placements of weighting material in accordance with embodiments of the present invention. The illustrated positions are presented for illustrative purposes only and, therefore, should not limit the present invention in any manner. Furthermore, the positions may be used individually or in combination to further customize the location of the center of gravity.

Weight location 510 illustrates a low-front-center location, which is located on the integrated sole and wall portion 112 adjacent to the face portion 110, that imparts less spin on the ball and a high trajectory, resulting in easier workability (the ability to hit the ball from left to right and vice versa) and more carry (the distance the ball travels in the air).

Weight location 512 illustrates a high-front-center location, which is located on the crown portion 114 adjacent to the face portion, that imparts less spin on the ball and a low trajectory, resulting in easier workability, less carry, and more rolling.

Weight location 514 illustrates a low-back-center location, which is located on the back-center of the integrated sole and wall portion 112, that results in more forgiveness and a high trajectory.

Weight location 516 illustrates a high-back-center location, which is located on the back-center of the crown portion 114, that results in more forgiveness and a low trajectory.

Weight location 518 illustrates a low-back-toe location, which is located on the back-center of the integrated sole and wall portion 112 along the toe, that results in more forgiveness and a high, fading trajectory.

Weight location 520 illustrates a high-back-toe location, which is located on the back-center of the crown portion 114 along the toe, that results in more forgiveness and a low, fading trajectory.

Weight location 522 illustrates a low-back-heel location, which is located on the back-center of the integrated sole and wall portion 112 along the heel, that results in more forgiveness and a high, drawing trajectory.

Weight location 524 illustrates a high-back-heel location, which is located on the back-center of the crown portion 114 along the heel, that results in more forgiveness and a low, drawing trajectory.

Weight location 526 illustrates a forward-center-center location, which is located on the center of the face portion 110, that results in easier workability with a neutral trajectory.

Weight location 528 illustrates a back-center-center location, which is located in the vertical-center of the integrated sole and wall portion 112, that results in neutrally forgiving club head.

Weight location 530 illustrates a low-center-center location, which is located on the center of the integrated sole and wall portion 112, that results in a neutral side-spin with a high trajectory. Note that this location is located on the weighting-port cover 120 for illustrative purposes only. As stated above, the weighting-port cover 120 may be located at any desired location, and a weight may be placed on the weighting-port cover 120 if so desired.

Weight location 532 illustrates a high-center-center location, which is located in the center of the crown portion 114, that results in a neutral side-spin with a low trajectory.

Figure 6:
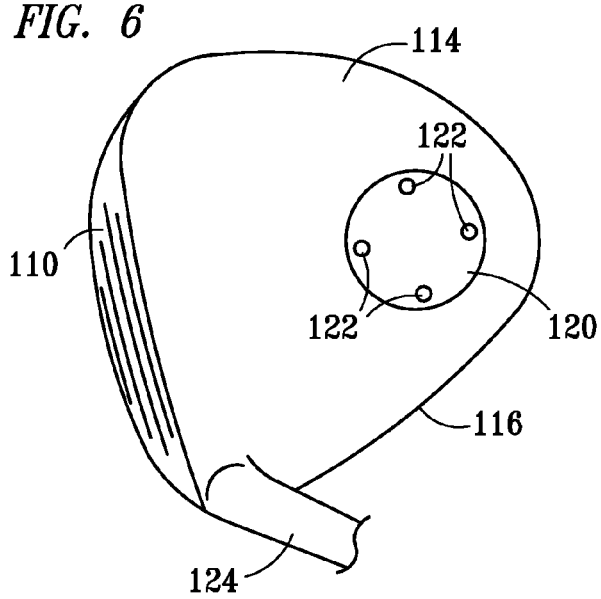
FIG. 6 illustrates a metal driver head embodying features of the present invention.

FIG. 6 illustrates a driver golf club head embodying features of the present invention in which the weighting-port cover 120 is located on the crown portion 114.

Figure 7:
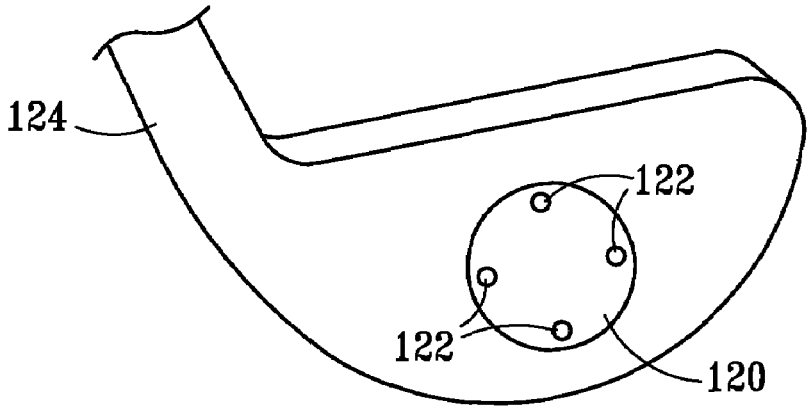
FIG. 7 illustrates a metal iron golf club head embodying features of the present invention.

FIG. 7 illustrates a hollow, iron golf club head embodying features of the present invention in which a weighting-port cover 710 is provided.

Figure 8:
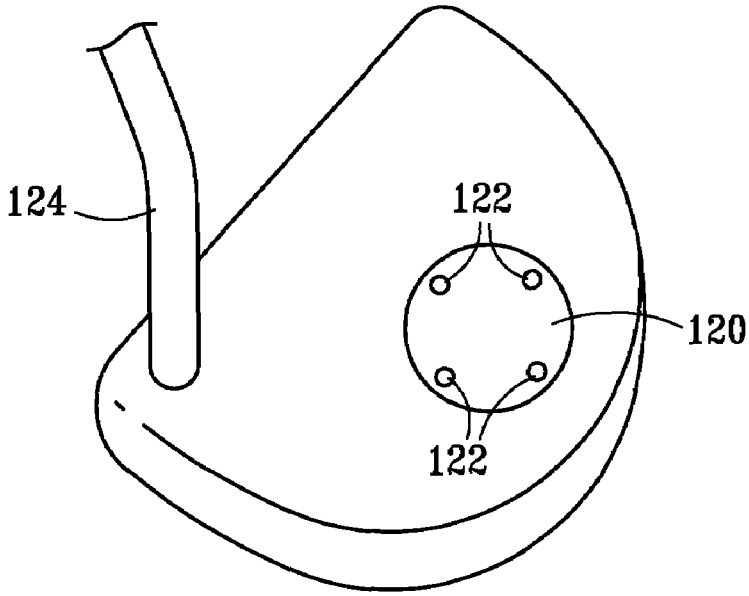
FIG. 8 illustrates a metal putter head embodying features of the present invention.

FIG. 8 illustrates a hollow, putter golf club head embodying features of the present invention in which a weighting-port cover 810 is provided.

It should be noted that the placement and size of the weighting port is shown for illustrative purposes only, and, therefore, should not limit the present invention in any manner.

It is understood that the present invention can take many forms and embodiments. Accordingly, several variations may be made in the foregoing without departing from the spirit or the scope of the invention. For example, the weighting port may be of a different shape and/or there may be a different method of accessing the interior of the club head, such as removing the sole of the club head, the back of the club head, or the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A method for adjusting a center of gravity of a golf club head after its manufacture, the golf club including a head comprising a hollow shell having a plurality of thin walls that collectively form a club head, the club head including a face for striking a golf ball, a heel portion, a toe portion, a back portion and a sole and having an original center of gravity prior to addition of any weights, the club head further including a plurality of user-attachable and detachable, discrete weights arranged on the shell at spaced-apart locations, the method comprising:

hitting golf balls with the club with the plurality of weights detachably secured to the shell in a first arrangement, in which the plurality of weights are positioned in at least two locations other than the sole, permitting movement of the center of gravity of the club head from the location of the original center of gravity toward the club face, wherein the sole is formed of one or more substantially planar surfaces at the bottom of the club head facing downwardly; and after hitting golf balls with the club, forming a second arrangement with the plurality of weights detachably secured to the shell, the second arrangement moving the golf club head center of gravity forward of the original center of gravity in the general direction of a first axis extending between the face and back portion of the head and in the general direction of a second axis extending between the heel and the toe portions.

2. The method of claim 1, wherein the step of forming the second arrangement of the plurality of weights further comprises moving the golf club head center of gravity in the general direction of a third axis extending between the golf club head sole and top.

3. The method of claim 1, wherein the step of forming the second arrangement of the plurality of weights further comprises removing a member secured to a port formed into the shell.

4. The method of claim 1, wherein the step of forming the second arrangement of the plurality of weights further comprises removing, from a port formed into the shell, a member to which at least one of the plurality of weights is attached.

5. The method of claim 1, wherein one of the plurality of weights is detachably secured to the head by a threaded coupling.

6. The method of claim 1, wherein at least one of the plurality of weights is detachably secured to the head by a threaded coupling.

7. The method of claim 1, wherein the step of forming the second arrangement with the plurality of weights further comprises at least partly threadably securing at least one of the plurality of weights to the shell.

8. The method of claim 1, wherein the step of forming the second arrangement with the plurality of weights further comprises press fitting at least one of the plurality of weights to the shell.

9. The method of claim 1, wherein the step of forming the second arrangement with the plurality of weights further comprises securing at least one of the plurality of weights to the shell by one or more latches.

10. The method of claim 1, further comprising:

providing an opening into the shell and one or more internal walls extending inwardly from the opening into the golf club head; and wherein the step of forming the second arrangement with the plurality of weights comprises removably securing at least one of the plurality of weights within the opening and against the one or more internal walls of the shell opening to attenuate vibration of the weighted member.

11. The method of claim 10, wherein the step of forming the second arrangement with the plurality of weights comprises at least partly threadably securing at least one of a plurality of weights to the shell.

12. The method of claim 10, wherein the step of forming the second arrangement with the plurality of weights comprises press fitting at least one of a plurality of weights to the shell.

13. The method of claim 10, wherein the step of forming the second arrangement with the plurality of weights comprises securing at least one of the plurality of weights to the shell by one or more latches.

14. The method of claim 1, wherein the step of forming the second arrangement of the plurality of weights further comprises:

detaching at least a part of the club head shell; and forming the second arrangement with the plurality of weights detachably secured to the shell.

15. The method of claim 14, wherein the step of detaching at least a part of the club head shell further comprises detaching at least a part of the back portion of the club head.

16. The method of claim 14, further comprising replacing the detached part of the club head shell.

17. The method of claim 1, wherein at least one of the plurality of weights comprises a member covering an opening in the shell, in at least one of the first and second arrangements of weights.

18. The method of claim 1, wherein at least one of the plurality of weights is at least partially secured within a recess in the shell, in at least one of the first and second arrangements of weights.

* * * * *